United States Patent [19]

Reinhall

[11] Patent Number: 4,878,997

[45] Date of Patent: Nov. 7, 1989

[54] METHOD AND APPARATUS FOR MANUFACTURING FIBRE PULP

[75] Inventor: Rolf B. Reinhall, Bellevue, Wash.

[73] Assignee: Sunds Defibrator Aktiebolag, Sundsvall, Sweden

[21] Appl. No.: 666,629

[22] PCT Filed: Feb. 14, 1984

[86] PCT No.: PCT/SE84/00053

§ 371 Date: Oct. 2, 1984

§ 102(e) Date: Oct. 2, 1984

[87] PCT Pub. No.: WO84/03313

PCT Pub. Date: Aug. 30, 1984

[30] Foreign Application Priority Data

Feb. 22, 1983 [SE] Sweden ..... 8300961

[51] Int. Cl.[4] ..... D21B 1/12

[52] U.S. Cl. ..... 162/23; 162/26; 162/261; 241/244; 241/261.2; 241/261.3

[58] Field of Search ..... 162/23, 26, 261; 241/261.2, 261.3, 244, 18, 21, 24, 28

[56] References Cited

U.S. PATENT DOCUMENTS

| | | | |
|---|---|---|---|
| 4,082,233 | 4/1978 | Reinhall | 241/244 |
| 4,221,343 | 9/1980 | Skeen | 241/244 |
| 4,301,974 | 11/1981 | Sjöbom | 241/244 |
| 4,350,499 | 9/1982 | Lundgren | 162/18 |

FOREIGN PATENT DOCUMENTS

| | | | |
|---|---|---|---|
| 2183928 | 12/1973 | France | 241/244 |

*Primary Examiner*—Peter Chin

*Attorney, Agent, or Firm*—Burns, Doane, Swecker & Mathis

[57] ABSTRACT

Fibre pulp is manufactured in a refiner with opposed refining members (22,23,24) rotary relative to each other and enclosed in a pressure-proof refiner housing (20). Steam is separated from the fibre pulp in the refiner housing (20) at the counter-effect of centrifugal forces generated by radial wing members (40) on a rotary refining member (23,24). The steam is led off separately from the refiner housing (20) through a steam outlet (42), which communicates with a space (41) radially inside of the wing members (40). The fibre pulp is discharged separately through a discharge device (50,60,70,80,90) while in the refiner housing the desired pressure is maintained.

12 Claims, 5 Drawing Sheets

METHOD AND APPARATUS FOR MANUFACTURING FIBRE PULP

Figure 1:
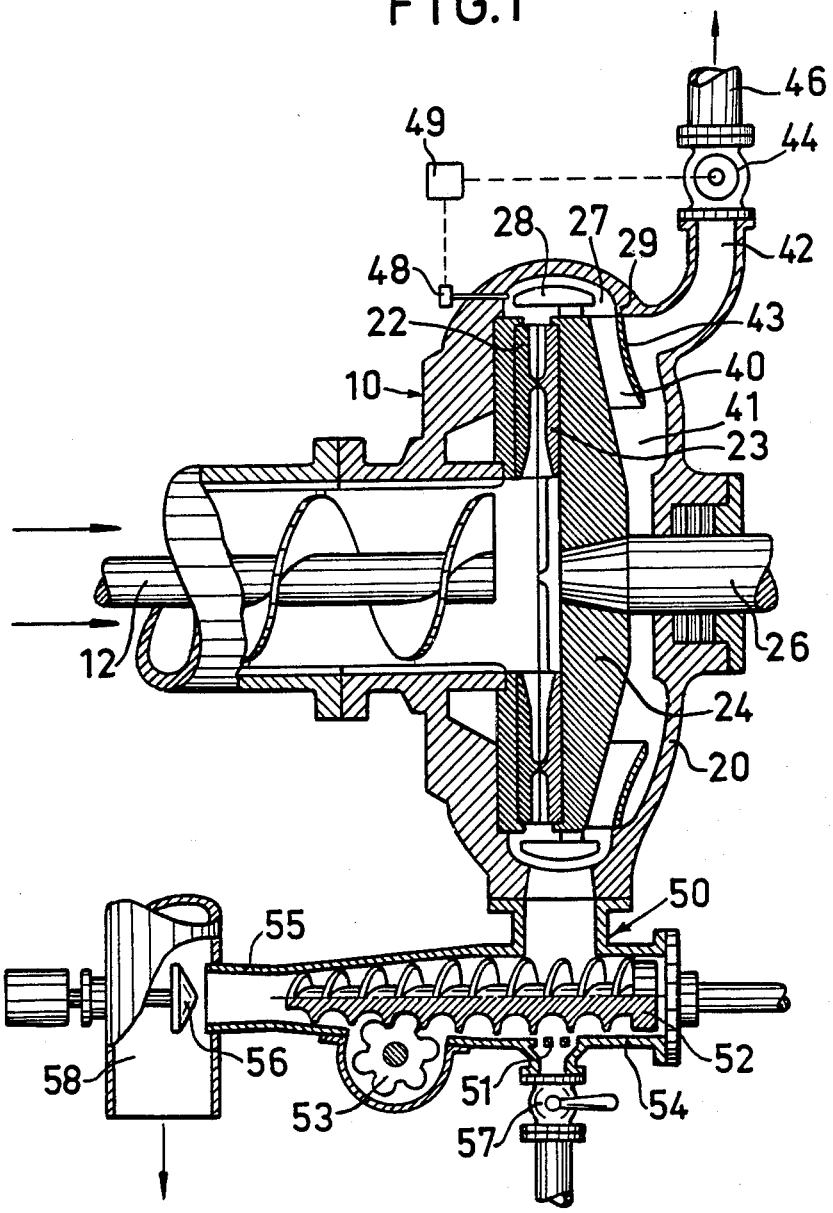

This invention relates to a method and an apparatus for entirely or partially recovering the heat and electric energy supplied at the manufacture of fibre pulp from lignocellulose-containing material, for example chips from soft- or hardwood, bamboo, straw, bagasse etc., comprising mechanical disintegration of chemically processed or unprocessed material at increased temperature to fibre state in a refiner comprising at least two refining members, which are rotary relative to each other and enclosed in a pressure-proof casing, and which have plane, conical, spherical refining surfaces, or a combination thereof. Opposed refining members, thus, may be rotatable in opposite directions, or one member may be rotatable and the other one stationary.

The mechanical disintegration of the material is effected in that the material is supplied to the inlet opening of the refining members and from there successively discharged through an adjustable gap maintained between the refining members.

This disintegration or refining of the materaial requires, depending on the type of manufactured fibre pulp, a varying amount of electric and steam energy (50–3500 kWh/ton) usually at a processing temperature of 100°–250° C.

These energy amounts supplied are converted at the refining operation substantially to heat, as a result of which the water following along with the material is evaporated and goes off from the processed material. In order to avoid high dry contents detrimental to the disintegration process (refining work), a water amount is added during the refining work which both adjusts the ingoing concentration of the material to be refined to the desired level and at the same time replaces the water amount evaporated during the refining work.

According to the present state of art, the fibre pulp manufactured at the disintegration has been discharged, together with the steam amount generated and/or supplied to the process, from the pressure-proof refiner housing to a separate receiving means, in which, for rendering possible maximum steam recovery, a steam pressure is maintained, which is equal to or slightly lower than the pressure maintained in the outlet zone of the refiner housing.

This receiving means, according to the present state of art, are provided with devices for separating the fibre pulp and the steam following along therewith from the refiner housing, and with a device for discharging the fibre pulp from the receiving means while maintaining the steam pressure therein.

The steam thus separated is led off from the receiving means with maintained pressure for being re-used in the process, whereby the greater part of the energy supplied to the refining process can be recovered.

The receiving means according to the aforesaid, thus, can be regarded as a pressure vessel. This fact, in combination with the fact that for achieving an effective separation of steam/refining produce relatively large vessel volumes are required, and also in combination with the requirement of control devices and corrosion-resistant materials, implies that the present apparatuses according to this method are very expensive.

The present invention renders it possible to more effectively separate fibres (refining produce)/steam already in the refiner housing being under overpressure and thereby eliminates entirely the need of separate receiving means located outside the refiner for the separation of fibre/stream. The invention, thus, reduces the installation and building costs. The characterizing features of the invention become apparent from the attached claims.

Figure 2:
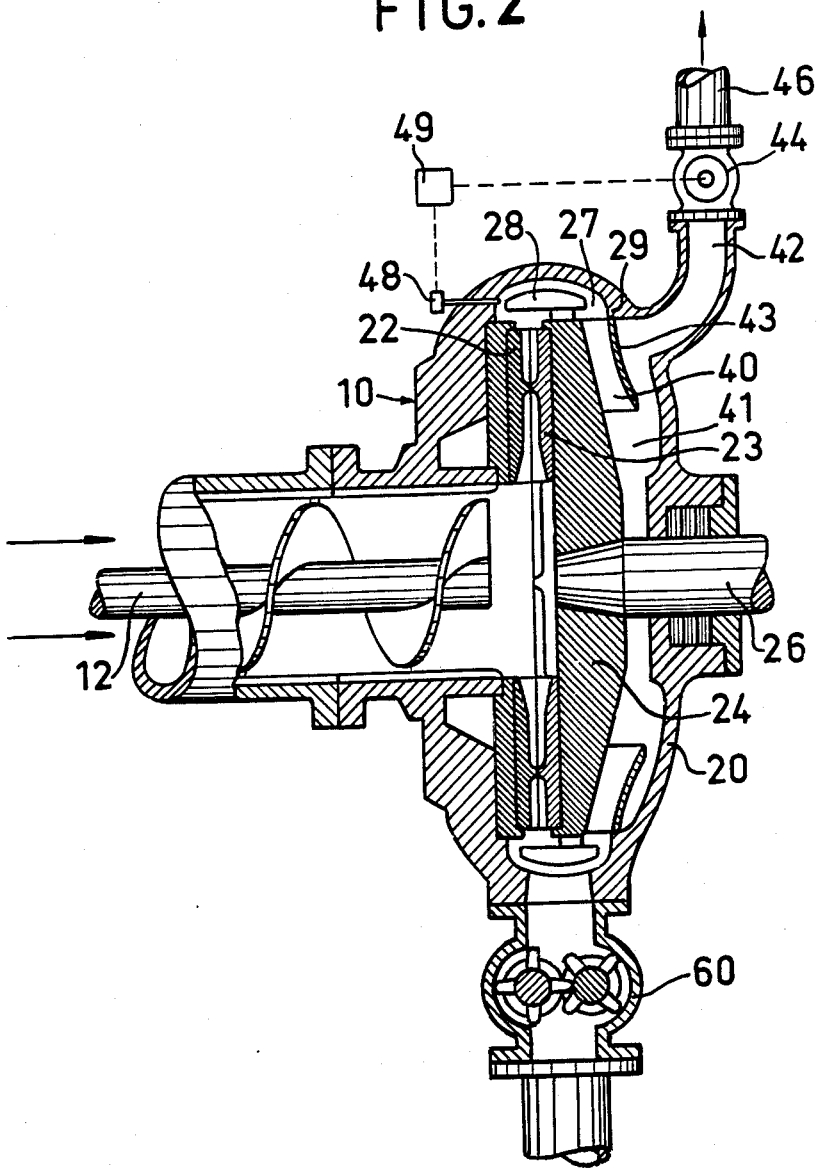
Figure 3:
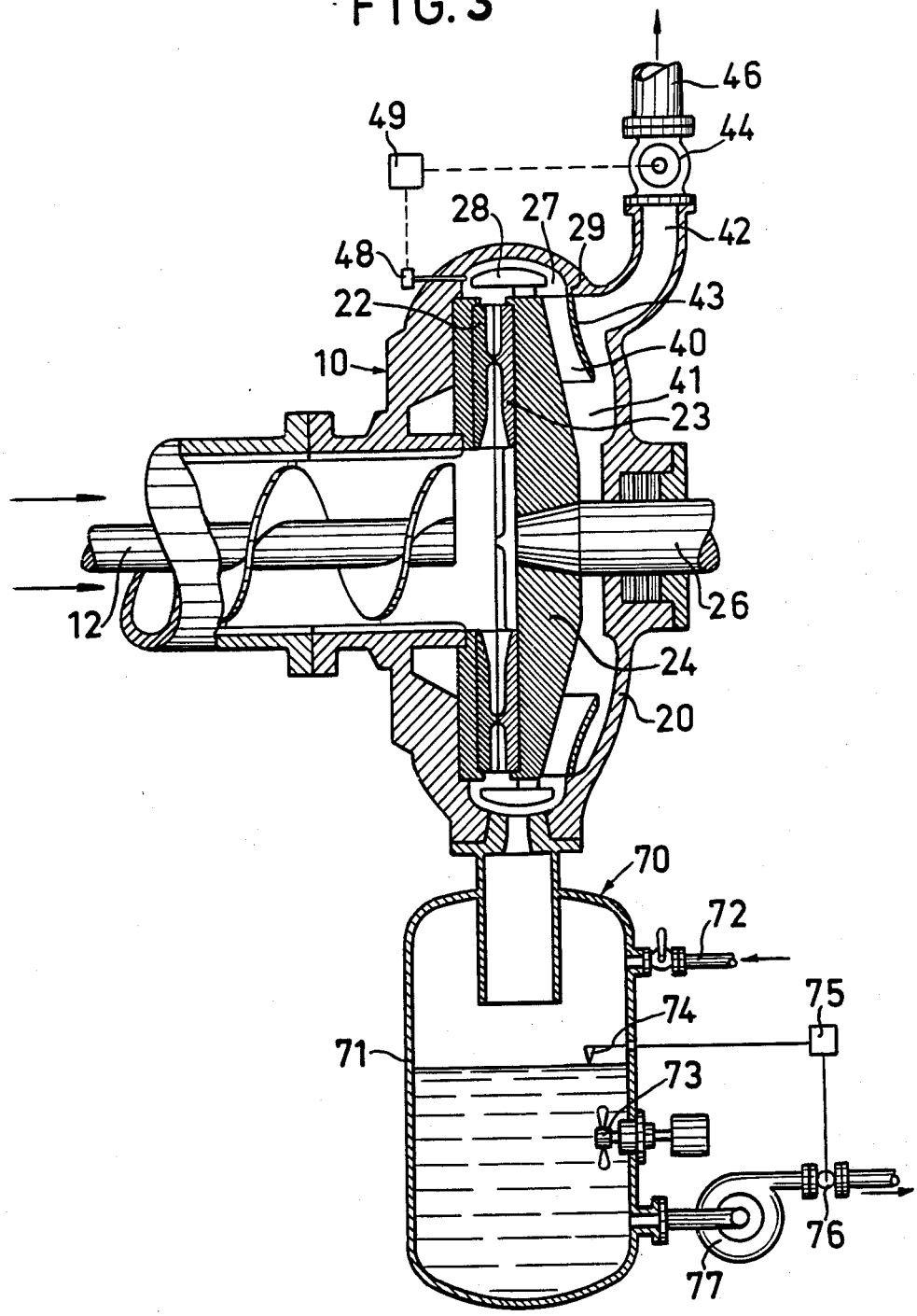
Figure 4:
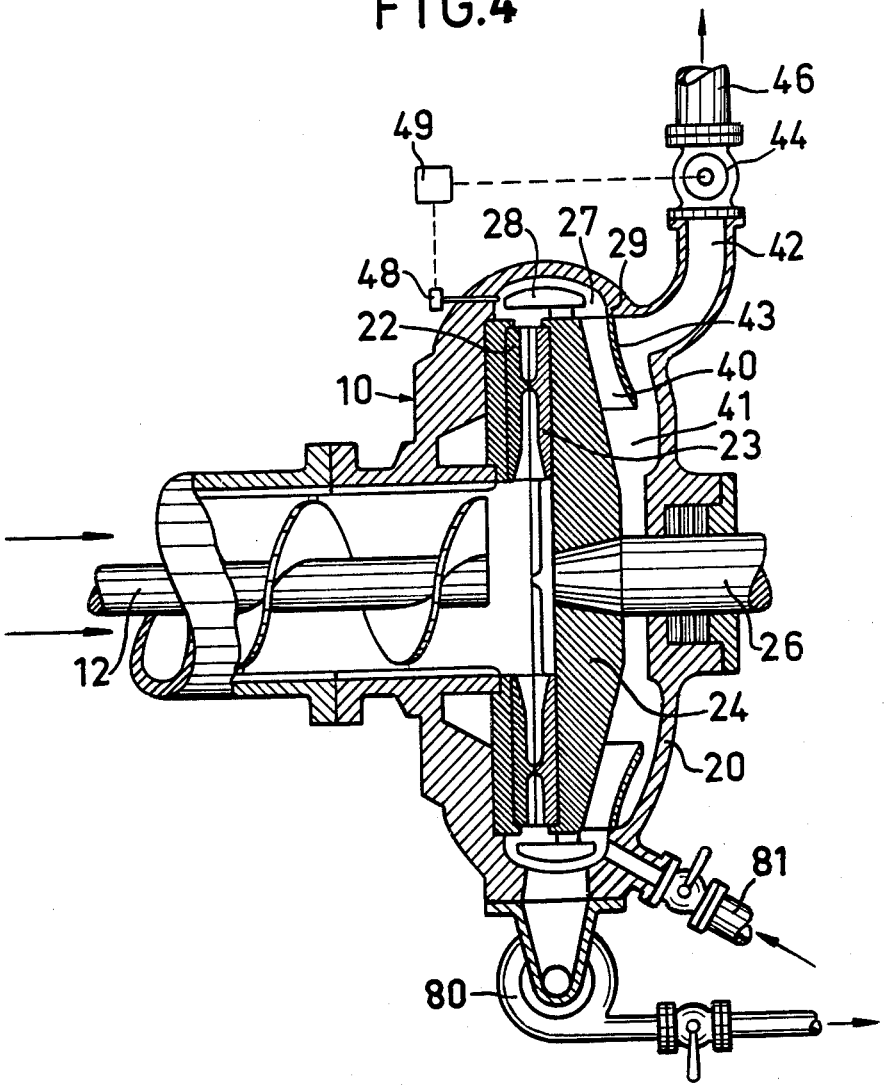
Figure 5:
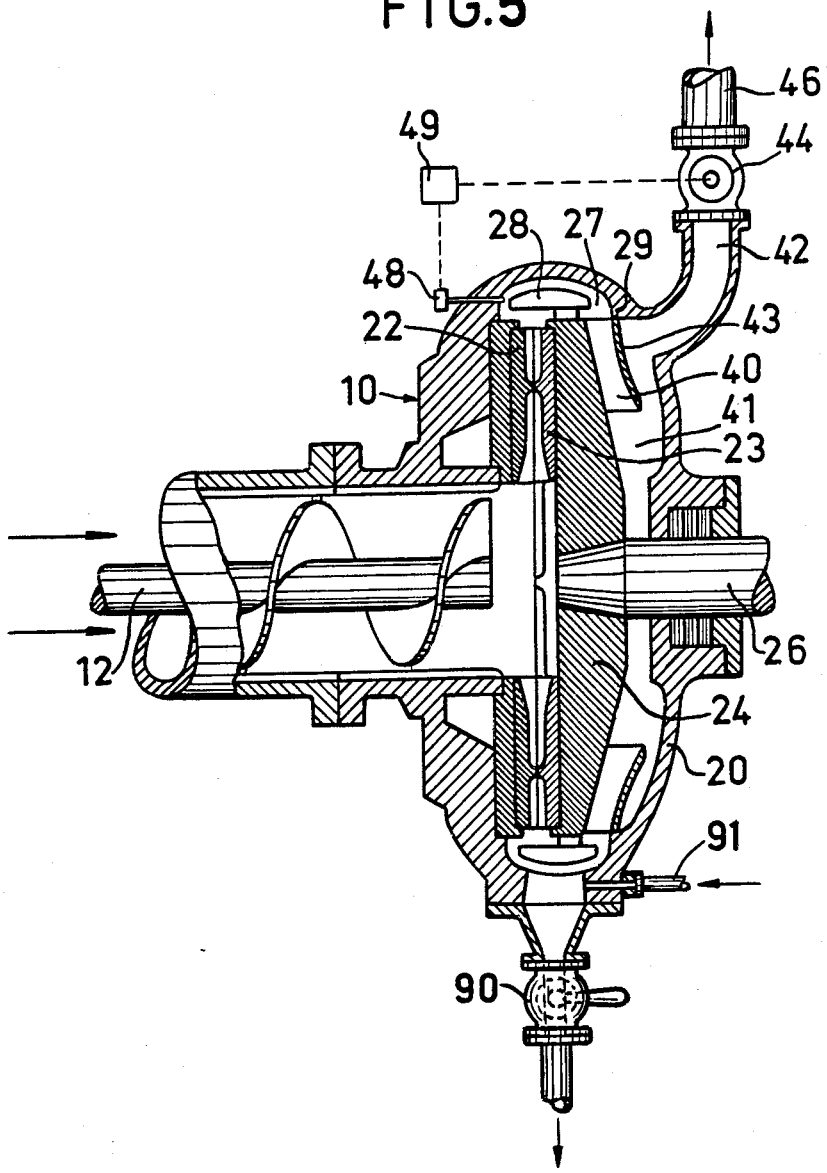

Some embodiments of the invention are described in greater detail in the following, with reference to the accompanying drawings, in which FIG. 1 is a schematic section of a refiner applicable in the process, comprising devices for fibre/steam separation in combination with a pressure-proof discharge device of screw type connected to the refiner housing, FIG. 2 shows the same device for separation, but with discharge means for discharge at high concentration and small amount of steam following along, or at lower concentration with liquid addition, FIG. 3 shows the same device for separation, but with means comprising liquid dilution and collecting vessel with stirrer operating under pressure, and discharge means, FIG. 4 shows the same device for separation, but with means for lower concentration of the type centrifugal pump or the like at discharge against pressure higher than that maintained in the outlet of the refiner housing, and FIG. 5 shows the same device for separation, but with means of valve type.

In the FIGS. 10, designates the refiner, which comprises a feeding-in conveyor 12, a pressure-proof refiner housing 20 and refining elements 22–23 enclosed therein, of which elements at the embodiments shown the stationary element 22 is rigidly connected to the refiner housing 20, and the rotary refining element 23 is supported on a rotor 24, which is connected to a drive motor (not shown) by a carrying and axially movable axle 26.

The rotor 24 is provided at its rear side with substantially radially disposed wing members 40, which open into a space 27 outside the periphery of the refining members 22,23,24 where it is sealed against the refiner housing by means of a circular shoulder 29. The wing members 40 are connected with a shield 43 so that substantially radially extending closed channels are formed between the wing members.

The material processed in the refiner is collected in the space 27 outside the refining members together with generated and/or supplied steam. The processed material is transferred from said space by means of one or several dogs 28 connected peripherally to the rotor 24 to a discharge device 50,60,70,80,90 connected pressure-proof to the periphery of the refiner housing 20.

According to the invention, the steam generated at the process and/or supplied thereto is forced from the space 27 outside the refining members to pass through the wing members 40 attached to the rear side of the rotor in the direction to the rotation centre of the rotor 24 to a steam outlet 42 shield off in the refiner housing from the collecting space 27.

During this passage through the wing members 40 the steam amount going off from the process, and the fibres suspended therein, are caused to assume a rotation speed corresponding to that of the rotor 24 and thereby are subjected to a centrifuging cleaning, which by the effect of the centrifugal force effectively returns refining produce following along with the steam to the space 27 separated from the steam outlet 42 for being transported further to the discharge device 50,60,70,80,90.

The steam amount going off and, thus, cleaned centrifugally is forced by the steam pressure generated in the process to flow in radial direction against the centrifugal force generated at the rotation of the rotor 24 (at the present state of art 500–3500 g, depending on diameter and number of revolutions) to a space 41, which is connected to the steam outlet duct 42.

This outlet duct is provided with a valve 44 and control means 48,49 for maintaining the optinum permissible steam pressure for the process, fro where the steam led off and pressure-controlled is discharged through a conduit 46 to be further utilized in the process or for other heat demands.

The embodiment shown in FIG. 1 is provided with a screw 52, which collects the fibre pulp (refiner produce) and compresses the material when it is discharged therethrough. Said screw is enclosed in a pressure-proof casing 54. This casing opens into an outlet conduit 58 through a discharge nozzle 55, in which the compressing of the material by means of a holding-on member 56 is adjusted to a density preventing steam supplied to or generated at the process to flow out. In order to prevent processed refiner produce to be imparted by the steam pressure maintained in the refiner housing with an uncontrolled discharge speed exceeding what is required for maintaining a pressure-proof discharge, a worm wheel 53 adapted in the threads of the screw conveyor is placed in engagement with the discharge screw 52. Hereby a free flow area is avoided, and at the same time the engagement of the worm wheel prevents discharged refiner produce to rotate with the discharge screw 52, which would result in kneading and and overfilling of the discharge device 50 and thereby bring about overfilling and plugging of the refiner housing in its entirety.

For the drainage of condensate and pressed-out liquid, the casing 54 is provided with a condensate outlet 51 and a valve 57 for flow control.

The discharge conduit 58 can be entirely filled with water for temporarily cooling discharged material. Simultaneously a sudden evaporation of liquid following along with the material is prevented. Such evaporation could imply overdrying of the discharged material, which would render subsequent processing more difficult.

In FIG. 2 an embodiment is shown, at which the fibre pulp (refiner produce) is discharged by means of a thick pulp pump 60, which renders possible discharge at high concentration and small amount of steam following along. At this embodiment, alternatively a lower concentration with liquid addition can be utilized.

At the embodiment according to FIG. 3 a discharge device 70 for lower concentration is used which comprises a collecting vessel 71 operating under pressure, with liquid dilution 72 and stirrer 73. This vessel 71 also includes means 74,75,76 for level control. From the vessel the discharge occurs in a controlled manner via a pump 77 or a usual valve so that the desired level is maintained in the vessel 71.

FIG. 4 shows a discharge device in the form of a centrifugal pump 80 or the like for lower concentration. The concentration of the fibre pulp is adjusted by liquid dilution through a supply conduit 81 at the outlet of the refiner housing 20. In this case the discharge takes place against a pressure higher than that maintained in the outlet of the refiner housing.

FIG. 5 shows a discharge device of valve type, i.e. a blow valve or other valve with or without liquid supply conduit 91 in the outlet of the refiner housing 20.

The present invention and structural solutions originating therefrom offer the advantage, that the steam amounts supplied to and/or generated at the refining process can be led off and separated from the refiner produce more effectively by utilizing only the rotary members comprising in the refiner housing. The steam thereby can be utilized at an optimum steam pressure, without the heat losses occurring at conventional methods and systems with separation systems provided outside the refiner housing.

The invention per se is not dependant on the type of discharge device used for the refiner produce, with the restriction, however, that the discharge device used is capable to maintain in the refiner housing the desired steam pressure. Thus, also discharge devices other than those shown can be imagined.

The discharge device, thus, can vary from comprising entirely pressure-proof devices to devices of the type thick pulp pump, usual pumps or valves, which also can be used when part of the steam or supplied liquid is used as flow-promoting agent.

The invention of course, is not restricted to the embodiments shown, but can be varied within the scope of the invention idea.

I claim:

1. A method of manufacturing fibre pulp from lignocellulose-containing material in a refiner provided with at least two opposed refining members rotatable relative to each other and enclosed is a pressure-proof refiner housing, so as to permit the material to be disintegrated during passsage of the material outwardly through a gap defined between the refining members and discharged from the refiner housing, including the steps of:

(a) providing steam in the pulp during the manufacturing;

(b) rotating at least one of the refining members so as to generate centrifugal forces;

(c) passing the pulp and the steam through the gap;

(d) separating the steam from the pulp by the centrifugal forces;

(e) discharging the steam from the refiner housing under pressure; and (f) discharging the pulp from the refiner housing under pressure.

2. A method as defined in claim 1, and further comprising the step of: forcing the steam first to flow inward against the effect of the centrifugal force and thereafter out of the refiner housing while at the same time forcing the fibre pulp following along to be returned and discharged separately from the refiner housing.

3. A method as defined in claim 1 or 2, and further comprising the step of compressing the fibre pulp during the discharge so that steam is prevented from flowing out with the fibre pulp.

4. A method as defined in claim 2, and further comprising the step of compressing the fibre pulp during the discharge so that steam is prevented from flowing out with the fibre pulp.

5. An apparatus for manufacturing fibre pulp from lignocellulose-containing material, comprising at least two opposed refining members rotatable relative to each other and enclosed in a pressure-proof refining housing, the refining members defining at least one gap therebetween in which the lignocellulose-containing material is disintegrated to fibre pulp, wherein at least one of the two refining members is provided on a side opposite said gap with substantially radial wing members positioned between a steam outlet and a pulp outlet defined in the refiner housing, said at least one of the two refining members rotatably driven to provide a centrifugal force and prevent the fibre pulp from flowing inward, a discharge device connected to the pulp outlet at a peripheral portion of the refiner housing so as to discharge the fibre pulp while maintaining a predetermined pressure in the refiner housing, and a space defined radially inwardly of the wing members in communication with the steam outlet.

6. An apparatus as defined in claim 5, and further comprising means for sealing the peripheral portion of the wing members against the refiner housing.

7. An apparatus as defined in claim 5, wherein the wing members are connected by at least one shield, so that closed passageways extending substantially radially are formed between the wing members.

8. An apparatus as defined in claim 5, wherein the steam outlet is provided with control means for maintaining the desired pressure in the refiner housing.

9. An apparatus as defined in claim 5, wherein the discharge device comprises a screw enclosed in a pressure-proof casing with a discharge nozzle and a holder-on member.

10. An apparatus as defined in claim 5, wherein the discharge comprises one of a pump and valve means.

11. An apparatus as defined in claim 10, wherein the discharge device comprises a collecting vessel operating under pressure and a level control means.

12. An apparatus as defined in claim 6, wherein the wing members are connected by at least one shield so that closed passageways extending substantially radially are formed between the wing members.

* * * * *